United States Patent [19]

Ishihara et al.

[11] 4,367,388

[45] Jan. 4, 1983

[54] COOKING HEATING APPARATUS

[75] Inventors: Masahiro Ishihara; Hajime Tachikawa; Kazuo Kaneko, all of Yokohama, Japan

[73] Assignee: Hitachi Heating Appliances Co., Ltd., Tokyo, Japan

[21] Appl. No.: 150,938

[22] Filed: May 19, 1980

[30] Foreign Application Priority Data

| | | | |
|---|---|---|---|
| Jun. 6, 1979 | [JP] | Japan | 54-70730 |
| Jun. 19, 1979 | [JP] | Japan | 54-77127 |
| Jun. 19, 1979 | [JP] | Japan | 54-77128 |
| Jun. 19, 1979 | [JP] | Japan | 54-77129 |

[51] Int. Cl.[3] ..... H05B 6/68

[52] U.S. Cl. ..... 219/10.55 B; 219/10.55 E; 219/10.55 F; 99/325; 350/584; 374/161

[58] Field of Search ..... 219/10.55 B, 10.55 R, 219/10.55 E, 219, 10.55 F, 10.55 M; 73/355 R; 350/61, 63, 65; 99/325, 331, 451, DIG. 14

[56] References Cited

U.S. PATENT DOCUMENTS

| | | | |
|---|---|---|---|
| 3,686,473 | 8/1972 | Shirn et al. | 219/219 |
| 3,783,220 | 1/1974 | Tanizaki | 219/10.55 E |
| 3,790,748 | 2/1974 | Van Laethem et al. | 219/219 |
| 4,015,476 | 4/1977 | Roche et al. | 73/355 R |
| 4,105,886 | 8/1978 | Baron et al. | 219/10.55 F X |
| 4,118,985 | 10/1978 | Compton | 73/355 R X |
| 4,191,876 | 3/1980 | Ohkubo et al. | 219/10.55 B |
| 4,259,866 | 4/1981 | Sleighter | 73/355 R |

FOREIGN PATENT DOCUMENTS

| | | | |
|---|---|---|---|
| 52-61848 | 5/1977 | Japan | 219/10.55 B |
| 54-106950 | 8/1979 | Japan | 219/10.55 B |

*Primary Examiner*—B. A. Reynolds
*Assistant Examiner*—Philip H. Leung
*Attorney, Agent, or Firm*—Antonelli, Terry & Wands

[57] ABSTRACT

A cooking heating apparatus is provided in which an object to be heated is subject to char cooking, the apparatus having a detector circuit for detecting the charred condition by detecting the intensity of reflected visible light from the surface of the object and a heating device for burning and removing foreign materials created upon heating the object and deposited on a transparent glass which is provided for preventing the foreign materials from reaching a light source which provides the visible light and a photosensor which detects the reflected visible light. The apparatus may further comprise means for forcing off the foreign materials burnt by the burning and removing elements by means of a forced air flow and/or a device for scattering the foreign materials given off from the object upon heating to prevent the foreign materials from reaching the transparent glass.

12 Claims, 6 Drawing Figures

COOKING HEATING APPARATUS

BACKGROUND OF THE INVENTION

This invention relates in general to cooking heating apparatus and more particularly to a cooking heating apparatus having a function to automatically control the charring operation of an object to be heated by detecting changes in the reflection factor of the surface of the object as the heating proceeds.

In cooking with a cooking heating apparatus, such as an electric oven, a gas oven or an oven range, wherein an object to be heated is put in a heating chamber and is subject to char cooking, it is conventional practice that the grade of the char condition of the object is estimated by a user through eye judgement or determined by a timer setting based on experience. However, the heating time for a desired grade of charring differs dependent on the quantity, water content, composition, shape and the like factors of the object to be heated and constant monitoring is required for attaining a proper grade of char.

To obviate this drawback, an automatic control for proper charring of an object to be heated has been proposed wherein a source of light is provided for irradiating visible rays on the object to be heated within a heating chamber, the intensity of reflection of the irradiated rays at the surface of the object is detected by a photo-sensor, and a heat generating source is controlled when the intensity of reflection reaches a predetermined magnitude.

This expedient for detection is acceptable in principle but has great difficulties to be solved before being put into practice. Namely, the optical system may be so contaminated by foreign materials or contaminants created upon heating the object, i.e. by scattered materials, that the intensity of irradiation rays onto an object to be heated as well as the intensity of reflected rays to be sensed by the optical sensor are decreased with the result that precise detection and control are impaired. Thus, how to keep the optical system substantially transparent with respect to light is unsolved with the above expedient.

SUMMARY OF THE INVENTION

This invention intends to solve the above problem and has for its object to provide a cooking heating apparatus capable of reliable detection of the charred condition.

According to this invention, there is provided a cooking heating apparatus comprising means for generating thermal energy for heating and charring an object to be heated within a heating chamber, means for supplying electric energy, light source means connected to the electric energy supply means and for irradiating the object to be heated by means of visible rays, means for detecting the intensity of reflected visible rays from the object, means for controlling the thermal energy generating means when the detected intensity of the reflection reaches a predetermined value, transparent glass means, disposed across a first light path extending from the light source means to the object and a second light path extending from the object to the detecting means, for preventing the light source means and detecting means from deposits of foreign materials created upon heating of the object, and means for burning and removing the foreign materials deposited on the transparent glass means.

DESCRIPTION OF PREFERRED EMBODIMENTS

Figure 1:
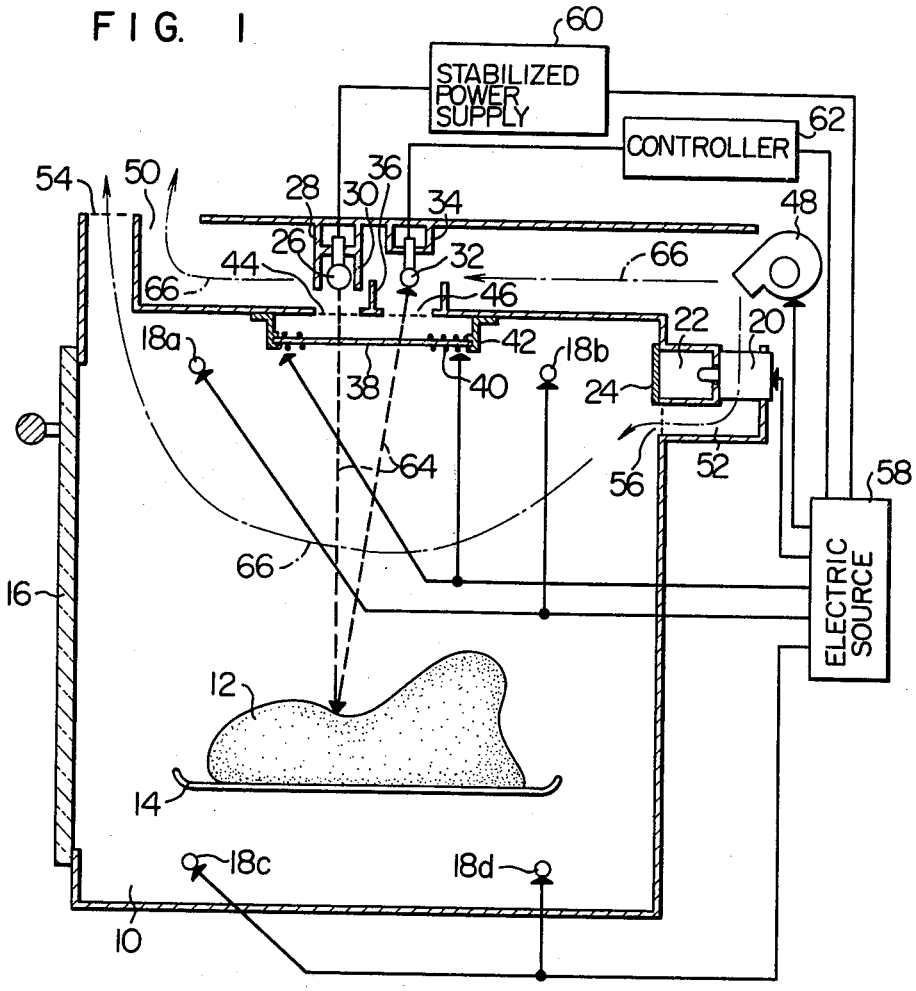
FIG. 1 is a schematic sectional view showing an embodiment of the cooking heating apparatus according to the invention.

Referring to FIG. 1, there is shown a cooking heating apparatus embodying the present invention which, only for illustration, takes the form of a high frequency or microwave energy heating type apparatus which has recently been in great demand. However, this invention is in no way limited to such a type of cooking heating apparatus. As shown, foodstuffs 12 to be heated are placed on a foodstuff dish 14 within a metallic heating chamber 10. The heating chamber 10 is provided at one side with an operable door 16. Electric heaters 18*a*, 18*b*, 18*c* and 18*d* are supported in the interior of the heating chamber 10 near its ceiling as well as at its bottom. These heaters are adapted to generate infrared ray energy which is effective to raise the temperature of the air in the heating chamber so as to char the foodstuffs 12. A source of heating energy such as a highfrequency or microwave energy generator 20 is provided to supply highfrequency or microwave energy to the interior of the heating chamber 10. A wave guide 22 interconnects the highfrequency or microwave energy generator 20 and the heating chamber 10. A partition plate 24 of a low highfrequency energy loss material covers the outlet opening of the wave guide 22 to block intrusion of crumb-like matters removed from the foodstuffs into the wave guide 22. A lamp 26 for irradiating visible rays on the foodstuffs 12 within the heating chamber 10 is mounted on a support member 28. This support member 28 is partly constructed as a hood 30 which prevents light emitted from the lamp 26 from directly reaching a neighbouring photo-sensor 32 and facilitates efficient irradiation of light from the lamp onto the foodstuffs. Light emitted from the lamp 26 impinges on the surface of foodstuffs 12 and reflection therefrom reaches the photo-sensor 32 to be detected thereby. The photo-sensor 32, which for example may be a photo-diode, is mounted on another support member 34. Direct detection of the light from the lamp 26 by the photo-sensor 32 is also prevented by means of a shield plate 36. There is provided a window glass plate 38 which is heat resistive and made of transparent glass of low highfrequency energy loss. The window glass plate 38 acts to prevent foreign materials created from the heated foodstuffs from coming to the lamp 26 and the photo-sensor 32.

An electric heater 40 mounted on a peripheral portion of the window glass plate 38 is energized as desired to heat the window glass plate 38 at 300° to 600° C. so that the foreign materials created upon heating the foodstuffs and deposited on the window glass plate may be heated and decomposed to keep the glass surface clean. The window glass plate 38 is held in a support frame 42 which is secured to the ceiling of the heating chamber. The ceiling is partly opened in register with the window glass plate 38 and metallic partition plates 44 and 46 are applied to cover the openings, the partition plates being apertured at such a density that the leakage of highfrequency or microwave energy out of the heating chamber is inhibited and at the same time the transmission of the light from the lamp 26 to the interior of the heating chamber 10 and reception of reflection from the foodstuffs 12 by the photo-sensor 32 are not disturbed. The cooling air from a fan 48 is partly supplied to the photo-sensor 32 and the lamp 26 and leaves the apparatus via an outlet 50. Also, the cooling air is partly directed to the highfrequency or microwave energy generator 20 as desired, namely, when the generator is in operation. After being warmed at the highfrequency energy generator 20, the air is passed through a duct 52 toward the interior of the heating chamber 10 whereat it is mixed with aqueous vapor given off from the foodstuffs 12, and is exhausted from the apparatus via an outlet 54. An opening of the duct 52 and the outlet 54 are so designed as to prevent leakage of the highfrequency or microwave energy therefrom. An electric source 58 is provided to feed the electric heaters 18*a* to 18*d*, highfrequency or microwave energy generator 20, photo-sensor 32, fan 48 and lamp 26. A stabilized power supply 60 is connected between the electric source 58 and the lamp 26. A controller 62 is connected between the photo-sensor 32 and the electric source 58 and it controls the latter in response to a signal from the former. In FIG. 1, broken lines 64 represent the paths of light, and one-dot-chain lines 66 represent the flows of cooling air.

In operation, the door 16 is opened, the foodstuffs 12 are placed on the foodstuff disk 14, and the door 16 is then closed. Upon the turning-on of the electric source 58, the electric heaters 18*a* to 18*d* are energized. Simultaneously, the lamp 26 is energized to irradiate visible rays on the foodstuffs via the perforated partition plate 44 and window glass plate 38, and the fan 48 is also energized to begin to feed cooling air. The photo-sensor 32 detects the rays reflected from the surface of the foodstuffs via the window glass plate 38 and the perforated partition plate 46. As heating proceeds, the high-temperature atmosphere inside the heating chamber 10 and especially infrared energy from the electric heaters 18*a* and 18*b* cause the surface of the foodstuffs to be charred and the intensity of reflection detected by the photo-sensor 32 gradually decreases. When the decreased intensity reaches a preset value, the controller 62 sends a signal to the electric source 58. Upon reception of the signal, the electric source 58 stops feeding the electric heaters 18*a* and 18*b* and lamp 26. The charring operation of the foodstuffs 12 has thus been completed. How to control the high frequency or microwave energy generator 20 is not essential to the present invention and either turning off the high frequency or microwave energy generator 20 in advance of the termination of charring operation or continuously keeping the generator on even after the termination of charring operation is selected dependent on the kind of foodstuff to be cooked.

After repetition of this type of charring cooking, foreign materials given off from the foodstuffs upon heating, say, oily materials and carbohydrate deposit on the surface of the window glass plate 38 to decrease the clearness of the glass plate. As described above, without eliminating the deposition, the accuracy of char detection might be degraded. Therefore, in accordance with the invention, the electric heater 40 mounted on the glass plate 38 is turned on timely to heat the glass plate 38, thereby burning and removing the foreign materials deposited on the surface of the glass plate. Turning-on of the electric heater 40 may be timed to manual operation which is effected when the contamination is observed through eye measurement or may otherwise be performed by a timing circuit (not shown) each time the cooking is completed. The electric heater 40 typically comprises a wired heater of nickel-chromium and it is disposed at the peripheral portion of the glass plate so as to ensure the transmission of light through the glass plate.

Figure 2:
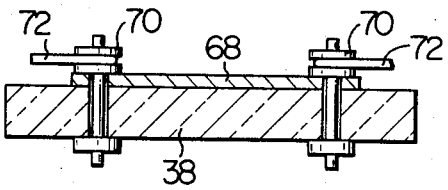
FIG. 2 is a fragmentary sectional view showing a modified embodiment of the glass window structure according to the invention.

The window glass plate structure may be modified as shown in FIG. 2 wherein a resistive heating layer is used in place of the electric heater 40 of FIG. 1. Specifically, a transparent conductive film 68 comprising a thin film of metallic tin or indium is formed on one or both surfaces of a heat resistive transparent glass plate 38. Electric power is supplied via a metallic electrode assembly 70 and conductors 72 to the thin film to thereby heat the thin film. As a result, foreign materials created upon heating foodstuffs and deposited on the surface of the glass plate 38 can be burnt and removed.

The cooking heating apparatus embodying the invention, as described in the foregoing, may use a heat generator of a highfrequency or microwave energy type, an electric energy type or a gas energy type. When highfrequency or microwave energy is used as heating energy, in either case where it is used alone or where it used along with other additional thermal energy, the metallic transparent conductive film 68 of tin or indium as shown in FIG. 2 modification may advantageously be constructed so as to absorb the highfrequency or microwave energy to thereby generate heat. In this case, the electrode assembly 70 and conductors 72 for feeding therefor as shown in FIG. 2 may be omitted. The highfrequency heating for the conductive film 68 may be timed by manual operation which is effected when the contamination is observed through eye measurement or to highfrequency heating cooking. In manual operation, there is required the provision of a dummy load for the highfrequency or microwave energy placed inside the heating chamber.

Figure 3:
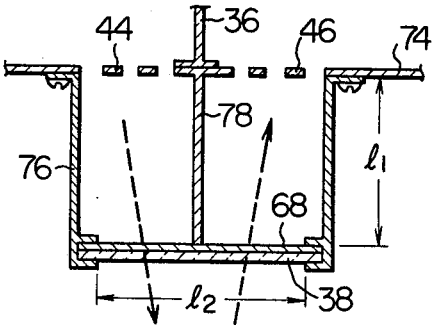
FIG. 3 is a fragmentary sectional view showing another modified embodiment of the glass window structure according to the invention.

FIG. 3 shows another modification of the glass window structure wherein a support frame is adapted to obtain efficient highfrequency or microwave energy heat generation at the aforementioned highfrequency or microwave energy absorptive conductive film applied on the heat resistive window glass. The support frame has a metallic cylinder 76 which extends at approximate right angles with respect to a ceiling 74 of the heating chamber and which is mounted at its fore end with a heat resistive glass window 38 applied on one or both surfaces with a conductive film 68. One surface of the glass window 38 confronts the interior of the heating chamber and will be deposited with foreign materials given off from the heated foodstuffs. The metallic cylinder 76 houses an internal metallic rod antenna 78. The metallic cylinder has a height $l_1$ which approximates to ¼ times the wavelength used (about 30 mm) so that the intensity of electric field is maximized in the vicinity of the conductive film and hence the conductive film 68 undergoes dielectric loss under the application of high frequency energy to generate heat which raises temperature in the glass plate 38 to thereby burn the foreign materials. It is possible to adjust temperatures in the glass plate by adjusting an opening diameter $l_2$ of the metallic cylinder 76 and the overall length of the antenna 78.

Figure 4:
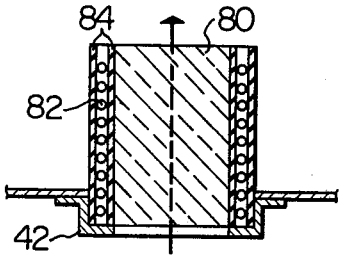
FIG. 4 is a fragmentary sectional view showing still another modification of the glass window structure according to the invention.
Figure 5:
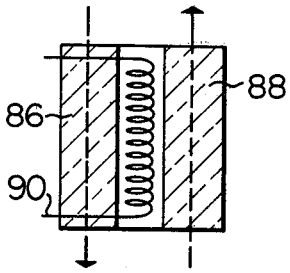
FIG. 5 is a fragmentary sectional view showing still another modification of the glass window structure according to the invention.

In the foregoing embodiments, the window glass structure has the glass plate but the window may be modified as shown in FIGS. 4 and 5 and as will be described hereunder.

In a window glass structure shown in FIG. 4, an electric heater 82 is wound about a glass rod 80. Preferably, individual window glass structures of this construction are provided for the path of irradiation rays from the lamp and for the path of reflection received by the photo-sensor. In FIG. 4, reference numeral 84 designates heat resistant insulating sheets for fixing the electric heater 82.

In a modified window glass structure shown in FIG. 5, an electric heater 90 is disposed in a gap between glass rods 86 and 88 which are positioned on the irradiation path and the reflection path, respectively. The electric heater 90 is effective to heat the two glass rods simultaneously.

Figure 6:
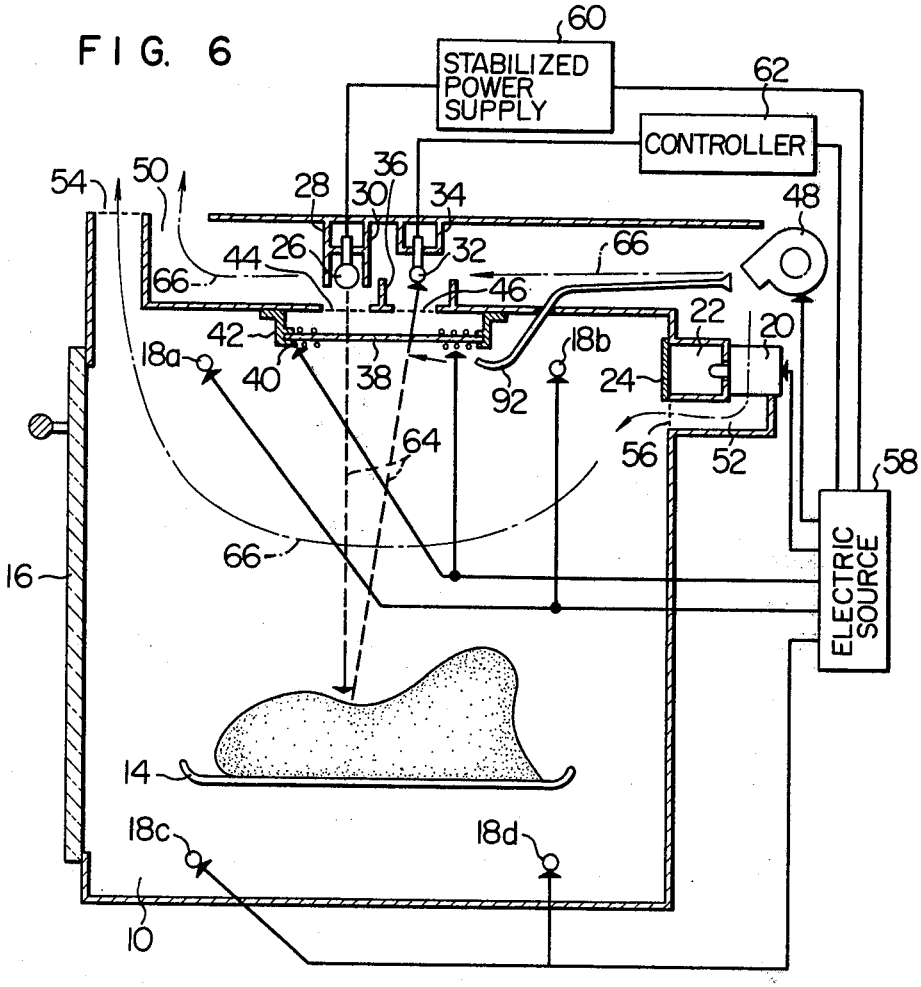
FIG. 6 is a schematic sectional view showing another embodiment of the cooking heating apparatus according to the invention.

Referring to FIG. 6, another embodiment of the cooking heating apparatus according to the invention will be described. This embodiment advantageously comprises, in addition to the aforementioned various means for burning and removing the foreign materials given off from the heated foodstuffs, means spraying forced air flow on the burnt residues for removing the same.

With the embodiments of FIGS. 1 to 5, burnt organic residues are still kept deposited on the glass window in the form of ashes and clearness of the glass window are degraded. FIG. 6 embodiment eliminates such drawbacks.

As shown in FIG. 6, there is provided an additional air flow pipe 92 of a heat resistant material. The forced air flow fed from a fan 48 is partly jetted onto the lower surface of a glass plate 40 confronting the foodstuffs via the pipe 92 so as to force off the residues deposited on the glass surface. A separate fan (not shown), in addition to the fan 48, may be provided which is exclusively used for feeding forced air flow for this purpose. Forced air flow may be jetted either in a direction perpendicular to a direction in which the foreign materials created upon heating are scattered, in a direction normal to the lower surface of the glass plate or in both the directions, thereby preventing the deposition of the scattered materials on the glass plate during heating. Alternatively, the air flow may automatically jetted onto the lower surface of the glass plate at the termination of burning of the foreign materials. Except for the air flow pipe 92, the FIG. 6 embodiment is the same as the FIG. 1 embodiment and the remaining components are not described herein. Obviously, modifications as described with reference to FIGS. 2 to 5 may be applicable to a window glass structure having an electric heater 40 of FIG. 6 embodiment.

As has been described, the present invention ensures automatic optical detection and controlling of the charring of foodstuffs in place of the conventional detection through eye measurement. The light source and the photo-sensor are separated from the foodstuffs by means of the glass partition plate to prevent the light source and the photo-sensor from being contaminated. The foreign materials deposited on the glass plate are burnt and removed and more preferably, residues of carbide still remaining on the glass plate are removed by forced air flow. Accordingly, the clearness of the glass plate can be constantly maintained to ensure that the grade of charred condition of the foodstuffs can automatically be controlled with high accuracy.

What is claimed is:

1. A cooking heating apparatus comprising:

a heating chamber;

means for generating thermal energy for heating and for charring an object to be heated within said heating chamber;

means for supplying electric energy;

light source means connected to said electric energy supply means and for irradiating said object by means of visible rays;

means for detecting the intensity of reflected visible rays from said object;

means connected to said detecting means for controlling said thermal energy generating means to change the operation thereof when the reflection intensity detected by said detecting means reaches a predetermined value;

transparent glass means disposed across a first light path extending from said light source means to said object and a second light path extending from said object to said detecting means and for preventing said light source means and said detecting means from being contaminated with foreign materials created upon heating the object; and means for burning and removing the foreign materials deposited on said transparent glass means.

2. A cooking heating apparatus according to claim 1, wherein said transparent glass means comprises a substantially transparent glass plate, and wherein said burning and removing means comprises electric heating means so disposed on at least one surface of said glass plate as to permit substantial transmission of light on said first and second light paths and being connected to said electric energy supply means.

3. A cooking heating apparatus according to claim 2, wherein said glass plate is supported by a support frame having a window opening such that said glass plate covers said window opening, and wherein said electric heating means comprises an electric heater disposed circumferentially of said window opening.

4. A cooking heating apparatus according to claim 2, wherein said electric heating means comprises a substantially transparent, electrically resistive and heat generative film applied on at least one surface of said glass plate and connected to said electric energy supply means.

5. A cooking heating apparatus according to claim 1, wherein said thermal energy generating means comprises highfrequency energy generating means, said transparent glass means comprises a transparent glass plate, and said burning and removing means comprises a transparent conductive film of a high dielectric loss material which is applied on at least one surface of said glass plate, said transparent glass plate being positioned such that said conductive film is heated by highfrequency energy from said highfrequency energy generating means.

6. A cooking heating apparatus according to claim 5, wherein said burning and removing means comprises antenna means for collecting the highfrequency energy to the vicinity of said transparent conductive film.

7. A cooking heating apparatus according to claim 6, wherein said burning and removing means comprises a metallic cylinder having a length which is ¼ times the wavelength of the highfrequency energy and a metallic rod antenna supported interiorly of said cylinder, whereby said glass plate covers one opening of said cylinder and said cylinder is supported interiorly of said heating chamber such that said first and second light paths are established through said glass plate and a hollow interior of said cylinder.

8. A cooking heating apparatus according to claim 1, wherein said transparent glass means includes a pair of substantially transparent glass rods, said glass rods being respectively arranged to establish therethrough and axially thereof said first and second light paths, and wherein said burning and removing means comprises a pair of electric heaters connected to said electric energy supply means, said pair of electric heaters being wound about the glass rods respectively.

9. A cooking heating apparatus according to claim 1, wherein said transparent glass means comprises first and second glass rods of substantial transparency, said first and second glass rods being respectively arranged to establish therethrough and axially thereof said first and second light paths, and wherein said burning and removing means comprises a single electric heater connected to said electric energy supply means and disposed adjacent to said first and second glass rods.

10. A cooking heating apparatus according to claim 1, 2, 3, 4, 5, 6, 7, 8 or 9, further comprising at least one of first means for spraying off the foreign materials which are created upon heating and burnt by said burning and removing means by means of forced air flow and second means for scattering the foreign materials given off from the object to be heated upon heating so as to prevent the foreign materials from reaching said transparent glass means by means of the forced air flow.

11. A cooking heating apparatus according to claim 1, 2, 3, 4, 8 or 9, wherein said thermal energy generating means comprises highfrequency energy generating means for heating the object to be heated, and electric heater means for charring the object, said highfrequency energy generating means and said electric heater means being connected to said electric energy supply means.

12. A cooking heating apparatus according to claim 5, 6 or 7, wherein said thermal energy generating means further includes electric heater means connected to said electric energy supply means and for charring the object to be heated.

* * * * *